US008764511B2

(12) United States Patent
Verbera et al.

(10) Patent No.: US 8,764,511 B2
(45) Date of Patent: Jul. 1, 2014

(54) TOY VEHICLE

(75) Inventors: Steven Verbera, Glendora, CA (US); Scott Hart Derman, Culver City, CA (US); Tyler Kenney, Los Angeles, CA (US)

(73) Assignee: Mattel, Inc., El Segundo, CA (US)

( * ) Notice: Subject to any disclaimer, the term of this patent is extended or adjusted under 35 U.S.C. 154(b) by 185 days.

(21) Appl. No.: 13/455,882

(22) Filed: Apr. 25, 2012

(65) Prior Publication Data

US 2012/0276809 A1 Nov. 1, 2012

Related U.S. Application Data

(60) Provisional application No. 61/518,167, filed on Apr. 29, 2011.

(51) Int. Cl.
*A63H 17/00* (2006.01)
*A63H 17/36* (2006.01)
*A63H 17/26* (2006.01)

(52) U.S. Cl.
CPC ..... *A63H 17/36* (2013.01); *A63H 17/262* (2013.01)
USPC ..... 446/465

(58) Field of Classification Search
USPC ..... 446/465
See application file for complete search history.

(56) References Cited

U.S. PATENT DOCUMENTS

| | | | |
|---|---|---|---|
| 2,601,930 | A | 7/1952 | Druge et al. |
| 2,832,177 | A | 4/1958 | Mueller |
| 3,115,724 | A | 12/1963 | Clarke |
| 3,236,006 | A | 2/1966 | Carroll |
| 3,387,404 | A | 6/1968 | Appel |
| 3,471,963 | A | 10/1969 | Tomiyama |
| 3,619,940 | A | 11/1971 | Good et al. |
| 3,629,680 | A | 12/1971 | Baynes et al. |
| 3,665,643 | A | 5/1972 | Colgrove |
| 3,707,805 | A | 1/1973 | Buck |
| 3,735,525 | A | 5/1973 | Freed |
| 3,747,265 | A | 7/1973 | Gagnon |
| 3,748,780 | A | 7/1973 | Glass et al. |
| 3,828,469 | A | 8/1974 | Giroud |

(Continued)

FOREIGN PATENT DOCUMENTS

| | | | |
|---|---|---|---|
| DE | 202010001555 | U1 | 4/2010 |
| GB | 224973 | A | 11/1924 |
| WO | 2011056243 | A2 | 5/2011 |

OTHER PUBLICATIONS

UK Search Report issued on Jul. 13, 2012 in UK Application No. GB1207386.2.

*Primary Examiner* — Kurt Fernstrom
*Assistant Examiner* — Dolores Collins
(74) *Attorney, Agent, or Firm* — Panitch Schwarze Belisario & Nadel LLP

(57) ABSTRACT

A toy vehicle has a frame pivotally supporting for side to side movement, front and rear carriages each having at least one road wheel to support and steer the vehicle. A steering control member is slidably supported between the carriages and moved sided to side by a steering actuator subassembly to simultaneously pivot facing ends of the carriages in the same lateral direction to steer the vehicle in the opposing lateral direction. The actuator subassembly simultaneously moves the vehicle body and a structure that simulate a pair of eyes in a front windshield area to simulate animated responses of the toy vehicle.

14 Claims, 8 Drawing Sheets

(56) References Cited

U.S. PATENT DOCUMENTS 3,862,514 A 1/1975 Ueda
4,079,938 A 3/1978 Beny et al.
4,083,143 A 4/1978 Allen
4,109,913 A 8/1978 Nielsen
4,155,197 A 5/1979 Beny et al.
4,187,637 A 2/1980 Nielsen
4,248,009 A 2/1981 Ferris et al.
4,260,041 A 4/1981 Mabuchi
4,366,645 A 1/1983 Crain et al.
4,385,466 A 5/1983 ReVelle
4,402,158 A 9/1983 Seki et al.
4,463,520 A 8/1984 Crosman
4,476,648 A 10/1984 Maxim
4,480,401 A 11/1984 Matsushiro
4,488,375 A 12/1984 Cheng
4,493,669 A 1/1985 Neuhierl
4,547,169 A 10/1985 Maxim
4,568,307 A 2/1986 Gabler et al.
4,701,150 A 10/1987 Alvarez
4,772,242 A 9/1988 McKay et al.
4,810,229 A 3/1989 Shoji
4,846,756 A 7/1989 Hesse
4,925,427 A 5/1990 Wu
5,092,808 A 3/1992 Takasaka et al.
5,108,126 A * 4/1992 Banse ..... 280/86.757
5,108,341 A 4/1992 DeSmet
5,141,464 A 8/1992 Stern et al.
5,173,072 A 12/1992 Ozawa
5,181,877 A 1/1993 Perkitny
5,259,808 A 11/1993 Garr
5,267,888 A 12/1993 Hippely et al.
5,292,275 A 3/1994 Swisher et al.
5,304,087 A 4/1994 Terzian et al.
5,310,379 A 5/1994 Hippely et al.
5,312,288 A 5/1994 Williams
5,334,077 A * 8/1994 Bailey ..... 446/466
5,334,078 A 8/1994 Hippely et al.
5,338,246 A * 8/1994 Suto ..... 446/466
5,338,249 A * 8/1994 Hildebrand et al. ..... 454/126
5,391,106 A 2/1995 Lidert, Jr.
5,409,263 A 4/1995 Klawitter
5,482,494 A * 1/1996 Ishimoto ..... 446/456
5,525,090 A 6/1996 Halford et al.
5,580,296 A 12/1996 Chow
5,626,506 A 5/1997 Halford et al.
5,722,872 A * 3/1998 Simmons et al. ..... 446/456
5,785,576 A * 7/1998 Belton ..... 446/456
5,876,263 A 3/1999 DeCesare et al.
5,882,241 A 3/1999 Mullaney et al.
5,916,007 A 6/1999 Maxim
5,941,754 A 8/1999 Maxim
6,015,330 A 1/2000 Simmons et al.
6,033,285 A 3/2000 Fine et al.
6,036,575 A 3/2000 Rehkemper et al.
6,039,626 A 3/2000 Gerold et al.
6,068,536 A 5/2000 Madland et al.
6,106,362 A 8/2000 Keller et al.
6,186,859 B1 2/2001 Hickman et al.
6,234,866 B1 5/2001 Ben-Yakar et al.
6,283,054 B1 * 9/2001 Engle ..... 112/152
6,352,464 B1 3/2002 Madland et al.
6,364,509 B1 4/2002 Johnson, III
6,383,054 B1 * 5/2002 Rauch ..... 446/456
6,551,169 B2 4/2003 Jaffe
6,599,169 B2 * 7/2003 Edmisson et al. ..... 446/466
6,620,023 B2 * 9/2003 Yeung ..... 446/466
6,626,116 B2 9/2003 Clark, Jr. et al.
6,645,037 B1 11/2003 Choi
6,663,463 B1 12/2003 Dougherty et al.
6,692,333 B2 2/2004 Kislevitz et al.
6,695,673 B1 2/2004 Stadbauer et al.
6,699,096 B2 3/2004 Christopherson et al.
6,699,097 B2 3/2004 Rudell et al.
6,742,613 B2 6/2004 Erlich et al.
6,758,718 B1 7/2004 Morris
6,767,272 B2 7/2004 Santarsiero
6,881,120 B1 4/2005 Janes
6,926,581 B2 8/2005 Lynders et al.
6,945,843 B1 * 9/2005 Motosko ..... 446/437
7,021,988 B2 4/2006 Patton
7,090,619 B2 * 8/2006 Miyamaru et al. ..... 482/57
7,115,014 B2 10/2006 McGrath et al.
7,121,917 B2 10/2006 Hardouin et al.
7,234,988 B2 6/2007 Patton
7,234,990 B2 6/2007 Leonov et al.
7,329,166 B2 2/2008 Hatting et al.
7,367,863 B2 5/2008 Fosbenner et al.
7,387,558 B2 6/2008 Swisher et al.
7,442,109 B2 10/2008 Fosbenner et al.
7,448,935 B2 11/2008 Trageser et al.
7,479,055 B2 * 1/2009 Saeki ..... 446/454
7,524,231 B2 4/2009 Matheny et al.
7,537,506 B2 5/2009 de la Torre
7,568,962 B2 8/2009 Amadio et al.
7,698,841 B1 4/2010 Vivat
7,722,430 B2 5/2010 Hippely
7,744,442 B2 6/2010 Rettberg et al.
7,762,867 B2 7/2010 Agostini et al.
7,811,152 B2 10/2010 McEntyre et al.
7,833,081 B2 11/2010 Hippely et al.
7,837,532 B2 11/2010 Reuter
7,841,920 B2 11/2010 Rettberg
8,517,790 B2 * 8/2013 Rehkemper et al. ..... 446/259
D691,675 S * 10/2013 Kim et al. ..... D21/533
8,562,386 B2 * 10/2013 Carlson et al. ..... 446/431
8,568,191 B2 * 10/2013 Rehkemper et al. ..... 446/259
2002/0077026 A1 6/2002 Li
2005/0003733 A1 1/2005 Ritter et al.
2005/0181703 A1 8/2005 Kuralt
2007/0254554 A1 11/2007 Ellman et al.
2008/0050999 A1 2/2008 Jang et al.
2008/0318491 A1 12/2008 Ishibashi et al.
2009/0029165 A1 1/2009 Goda
2009/0036020 A1 2/2009 Nelson et al.
2009/0075557 A1 3/2009 Arriola et al.
2009/0093185 A1 4/2009 Maxim
2009/0197504 A1 8/2009 Hsu
2009/0233518 A1 9/2009 Hui
2009/0298384 A1 12/2009 Connolly
2010/0023148 A1 1/2010 Komorous-Towey et al.
2010/0130096 A1 5/2010 Baarman et al.
2010/0144239 A1 6/2010 Eck et al.
2010/0167623 A1 7/2010 Eyzaguirre et al.
2011/0104980 A1 5/2011 Bond
2011/0189923 A1 8/2011 Bruder

* cited by examiner

TOY VEHICLE

CROSS REFERENCE TO RELATED APPLICATIONS

This application is related to U.S. Application No. 61/0518,167 filed Apr. 29, 2011, which is incorporated by reference herein in its entirety.

BACKGROUND OF THE INVENTION

Hippely et al. U.S. Pat. No. 7,833,081 describes a motorized toy vehicle having a fanciful facial expression formed by pairs of moving eyes and eye brows under a front windshield and a movable mouth in the front grill area of the vehicle. Propulsion and steering of the toy vehicle is conventional. The mouth and eye components may be moved together by a pair of motor driven, coaxial cams or the mouth motor driven and the eye components moved manually through a control button on the vehicle roof. All disclosed versions of these toy vehicles require three electrically operated actuators: a propulsion motor, a steering motor/servo and a special effect motor moving the mouth or mouth and eye components.

It would be desirable to increase the number of animated features of these toy vehicles without adding additional electrically operated actuators.

BRIEF SUMMARY OF THE INVENTION

In a primary aspect, the invention is a toy vehicle comprising: a vehicle frame having opposing front and rear ends and opposing lateral sides extending between the ends; a front wheel carriage mounted for lateral side to side pivotal movement on the vehicle frame proximal the front end of the vehicle frame; at least one front road wheel rotatably mounted on the front wheel carriage so as to support the front end of the frame for movement of the toy vehicle; a rear wheel carriage mounted for lateral side to side pivotal movement on the vehicle frame proximal the rear end of the vehicle frame; at least one rear road wheel rotatably mounted on the rear wheel carriage so as to support the rear end of the frame for movement; a steering control member located between and operably connected directly with each of the front and rear wheel carriages so as to simultaneously pivot proximal adjoining inner ends of the front and rear wheel carriages in one lateral direction on the frame and thereby pivot the distal outer ends of the front and rear wheel carriages simultaneously in an opposing remaining lateral direction on the frame whereby the vehicle can be steered in the opposing remaining lateral direction; a steering actuator configured to move the steering control member laterally to steer the toy vehicle in a desired lateral direction; and a controller operably connected with the steering actuator to activate the steering actuator to move the steering control member and thereby pivot the front and rear wheel carriages to steer the toy vehicle.

In another aspect, the invention is a toy vehicle comprising: a plurality of rotatably mounted road wheels arranged to support the toy vehicle for movement on a support surface; a structure movably mounted so as to generate an animated response of the toy vehicle; a steering actuator operatively connected with at least one of the plurality of road wheels to pivot the at least one road wheel with respect to a vertical axis to steer the toy vehicle and to simultaneously move the structure and the steering control member to thereby pivot at least the one road wheel to selectively steer the toy vehicle simultaneously while generating the animated response.

In yet another aspect, the invention is a toy vehicle comprising: a vehicle frame; a plurality of road wheels supported from the vehicle frame and supporting the toy vehicle for movement, at least one of the road wheels being mounted to the chassis for pivotal movement about a vertical axis so as to steer the toy vehicle; a vehicle body mounted on the vehicle frame so as to rock about an other axis extending through the toy vehicle between the front and rear ends; and an actuator subassembly operatively connected with the at least one road wheel and the vehicle body so as to rock the vehicle body about the other axis while simultaneously pivoting the at least one road wheel to steer the toy vehicle.

BRIEF DESCRIPTION OF THE DRAWINGS

The foregoing summary, as well as the following detailed description of the invention, will be better understood when read in conjunction with the appended drawings. For the purpose of illustrating the invention, there are shown in the drawings embodiments which are presently preferred. It should be understood, however, that the invention is not limited to the precise arrangements and instrumentalities shown. In the drawings.

DETAILED DESCRIPTION OF THE INVENTION

Figure 1:
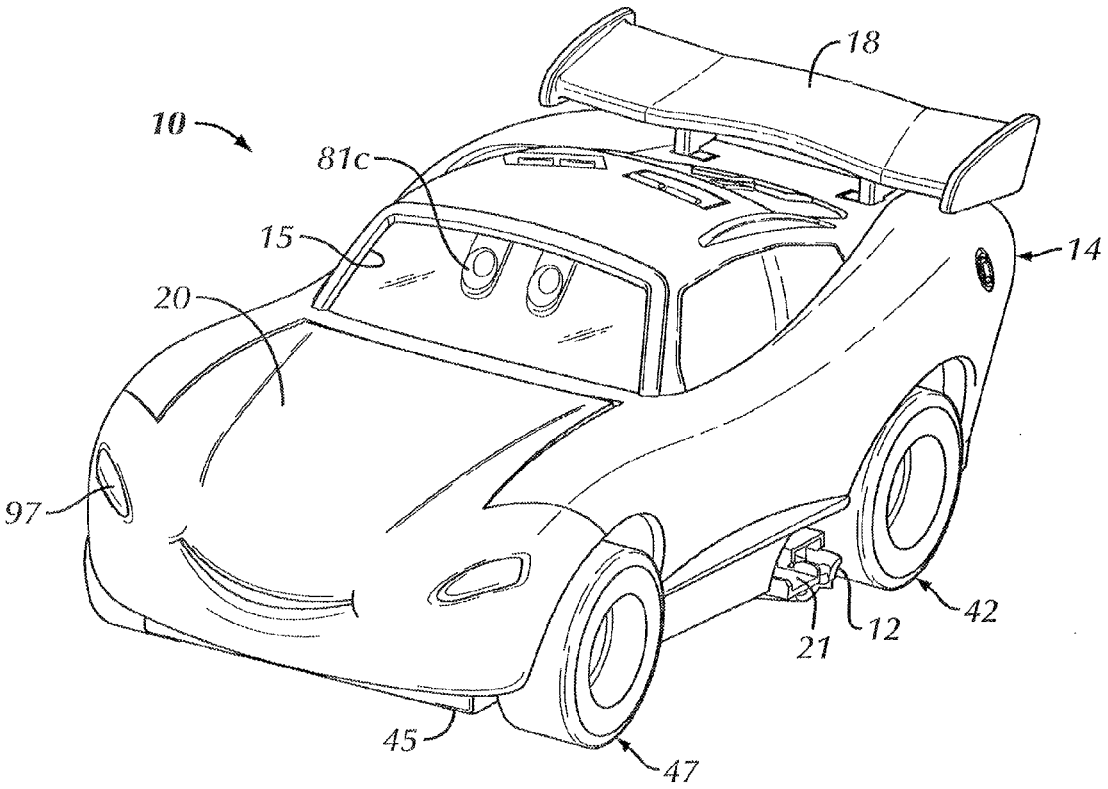
FIG. 1 is a front perspective view of a motorized toy vehicle embodying the invention.
Figure 2:
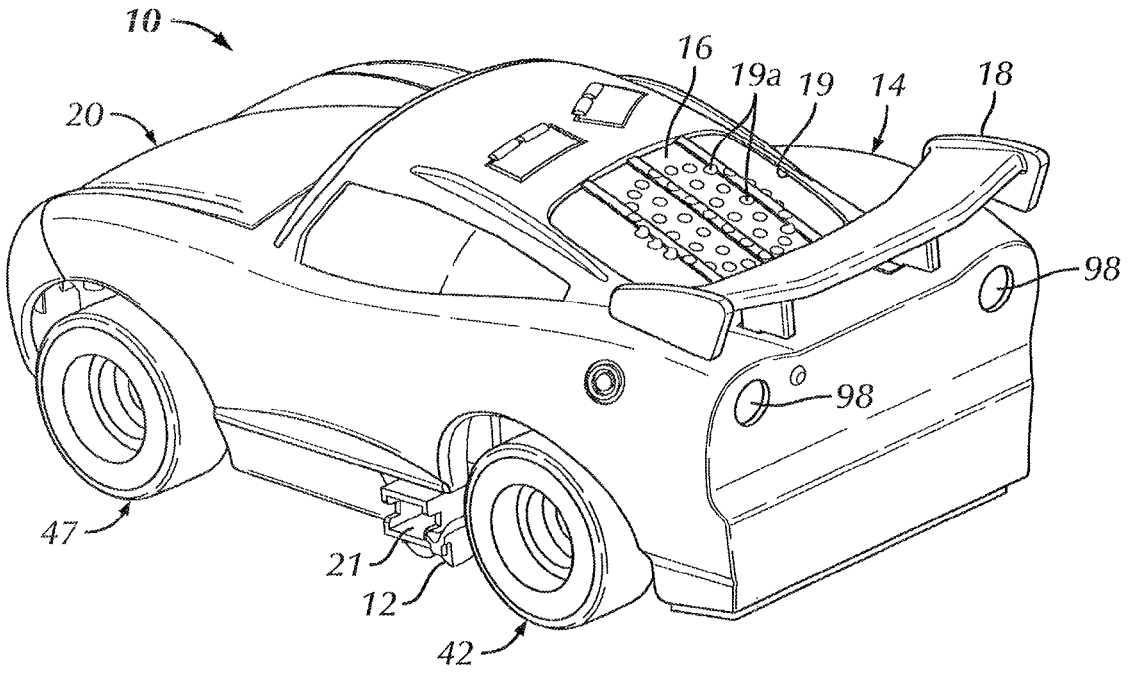
FIG. 2 is a rear perspective view of the toy vehicle.

In the various figures, like numerals will be used to indicate like elements. FIGS. 1 and 2 depict a first embodiment toy vehicle 10 embodying the invention. The vehicle 10 includes a body 14, a least one and preferably a pair of front road wheels 47 and at least one and preferably a pair of rear road wheels 42. The body 14 preferably includes a flexible member 20 forming a "nose" 20*a* and a "mouth" 20*b*, has a front window opening 15 defining a front windshield area (also 15) and a rear window opening 19. It mounts a decorative rear spoiler or wing 18. A electrical jack 21 is preferably provided configured to matingly receive a plug connector (not depicted) for recharging an on-board power supply 22 of the vehicle 10. Working LED headlights 97 and taillights 98 are optionally provided as is a speaker 92, the sound from which is permitted to pass through holes 19*a* in the rear window area 19 above the speaker 92.

Figure 3:
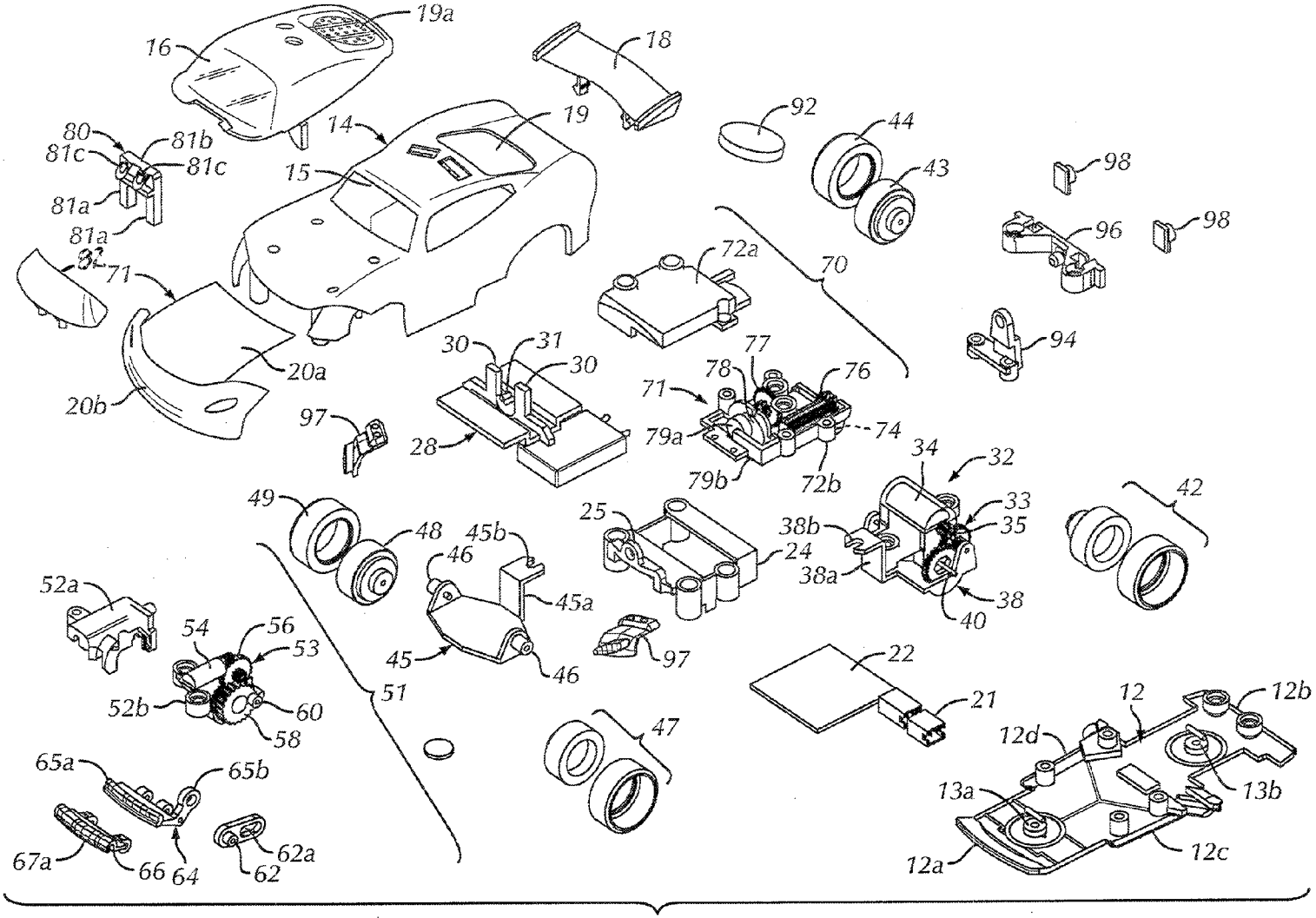
FIG. 3 is an exploded view of a first mechanical embodiment of the toy vehicle.

Referring to FIG. 3, most of the individual components of the toy vehicle 10 are revealed in exploded view. Preferably the vehicle construction is body 14 supported on a chassis preferably including a vehicle frame 12. Frame 12 has opposing front and rear ends 12*a*, 12*b* and opposing left and right lateral sides 12*c*, 12*d* extending between the ends 12*a*, 12*b*. While frame and body construction is preferred, split shell or other monocoque construction can be used.

The toy vehicle 10 has three motor/gear subassemblies that each include an electric motor and speed reduction gearing. A first motor/reduction gearing combination is indicated generally at 33 and is part of a propulsion module or subassembly 32 at the rear of the vehicle 10. A second motor/reduction gearing combination is indicated generally at 53 and is part of a special effects (FX) "mouth" module or subassembly indicated generally at 51 at the front end 12*a*. Second motor/reduction gearing combination 53 is a configured as a servo to operate a "mouth" 50 formed by flexible member 20 by moving upper and lower jaws 64, 66 of the mouth subassembly 51. A third motor/reduction gearing combination is indicated generally at 71 and is configured as another servo that is located between and above the propulsion and mouth subassemblies and their motor/reduction gearing combinations. Third motor/reduction gearing combination is part of a steering module or subassembly 70 that controls animated movement of the toy vehicle as well as steering as will be described. Servos provide only limited rotational output, whether through stop switches or slip clutches or the like. Preferably, all of the motors/servos are reversible.

Each of the pair of front road wheels 47 is preferably formed by hub or rim 48 and tire 49 but one-piece and other constructions are possible. The pair of front road wheels 47 are mounted for free rotation on opposing stub shafts 46 provided in fixedly coaxial positions on opposite sides of a front wheel carriage 45 and support the front end 12*a* of the vehicle frame 12 and the toy vehicle 10 for movement of the vehicle on a support surface. The stub shafts 46 are fixedly coaxial on the front wheel carriage and, by their rotatable mounting, the front wheels 47 are thus also coaxially mounted to rotate about a common axis fixed with respect to the carriage 45. The propulsion module/subassembly 32 is otherwise conventional and is mounted in or on a rear wheel carriage 38. Rear road wheels 42 are fixed on a rear axle 40 of the propulsion module 32 and support the rear end 12*b* of the vehicle frame 12 and vehicle 10 for movement of the vehicle. Rear axle 40 is driven by a propulsion motor 34 and reduction gear train/transmission 36. The rear axle 40 is fixed in location on the rear wheel carriage 38 and thus the rear wheels 42 are also mounted for rotation about a common axis, the central axis of the axle 40, fixedly positioned on that carriage 38. Each rear road wheel 42 is also formed by hub or rim 43 and tire 44. The front and rear road wheels 42, 47 may be identical as indicated or different, as desired.

Figure 4:
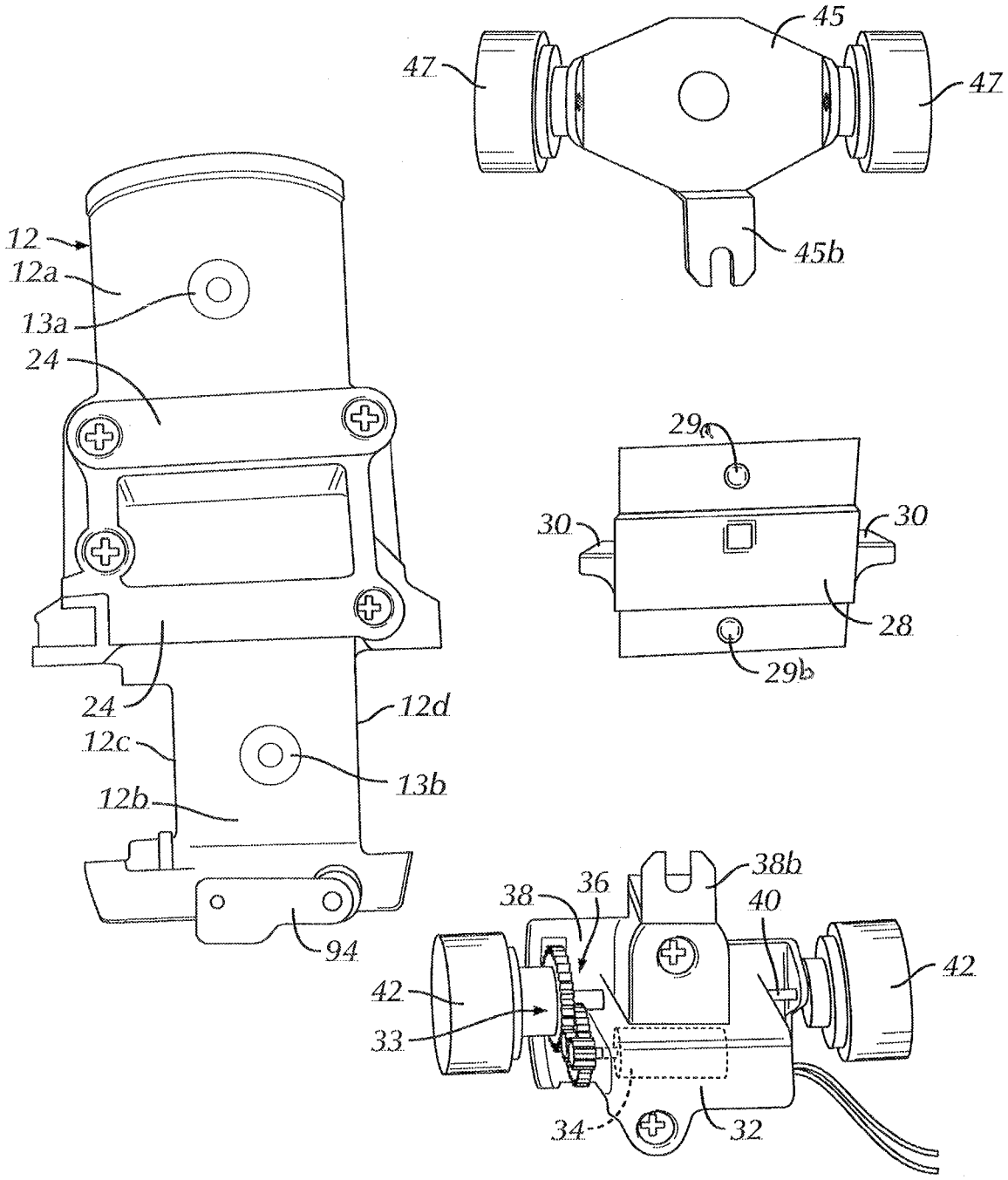
FIG. 4 is a first partially reassembled view of the toy vehicle of FIG. 3.
Figure 5:
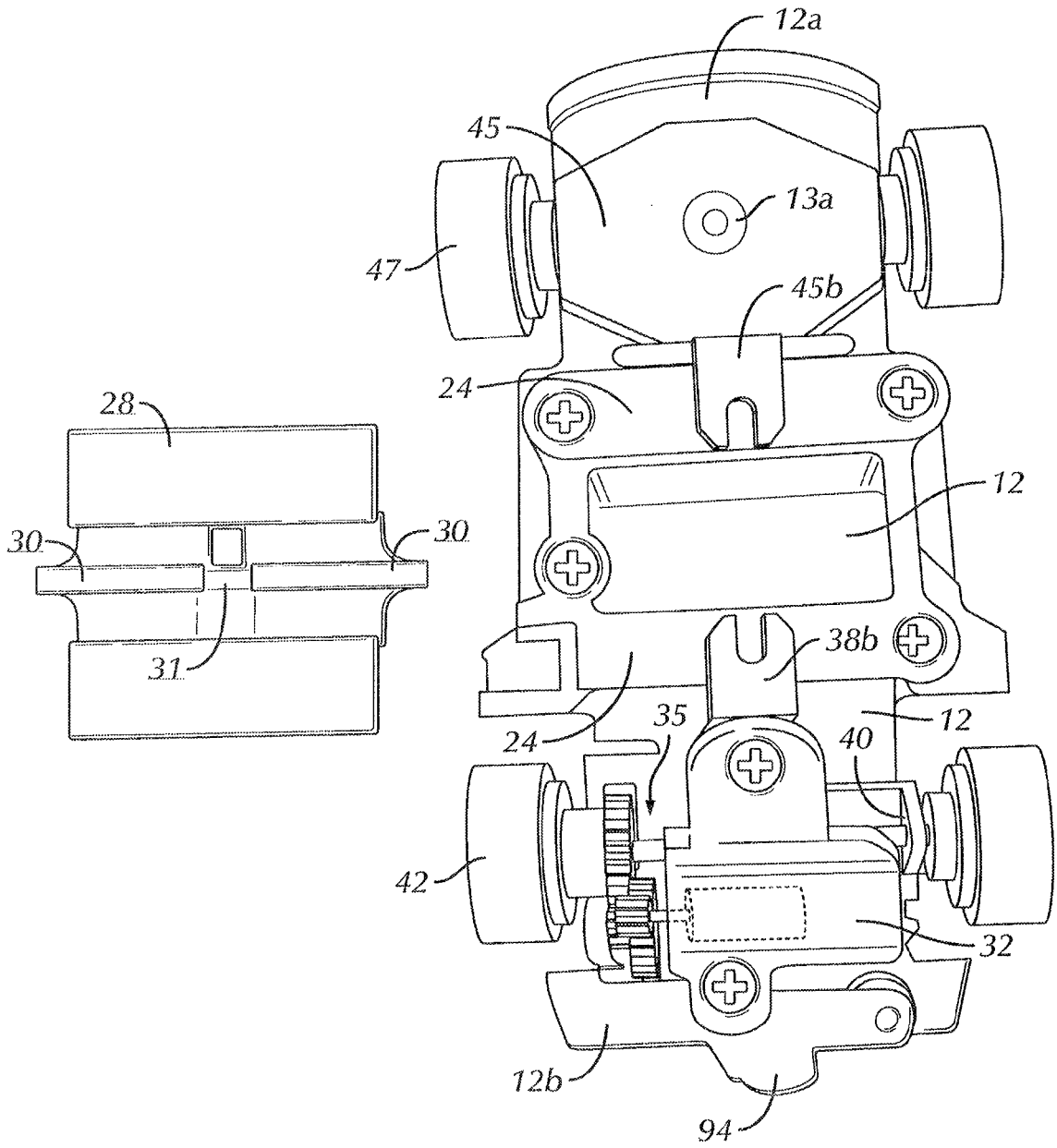
FIG. 5 is a second partially reassembled view of the toy vehicle of FIG. 3.

Referring to FIGS. 3 and 4, the front wheel carriage 45 is itself mounted on the frame 12 on a vertically extending front post 13*a* proximal the front end 12*a* of the frame 12 for lateral side to side pivotal movement about a vertical central axis of the front post. The rear wheel carriage 38 is also pivotally mounted on the frame 12 on a separate, vertically extending rear post 13*b* proximal the rear end 12*b* of the frame 12 for side to side pivotal movement about a vertical central axis of the rear post. An upper chassis member 24 is fixed to the frame 12 between the wheel carriages 45, 38 and slidably supports a steering control member 28 located between and operably connected directly with each of the front and rear wheel carriages. FIG. 4 shows a bottom side of the control member 28. Pins 29*a*, 29*b* extend down from the front and rear, laterally extending horizontal panels or flanges of steering control member 28 are receive in yokes 38*b*, 45*b* provided at the free ends of front and rear control arms 38*a*, 45*a*, respectively provided at mutually facing ends on the front and rear wheel carriages 38, 45. FIG. 5 shows the vehicle frame 12 with the steering control member 28 removed revealing its top side. Extending vertically and laterally side by side in the top center of the steering control member 28 are a pair of spaced apart, planar parallel rigid ribs 30 that define a gap 31 in between. The gap 31 receives a steering actuator member in the form of crank 79*b* (see FIG. 6) that is exposed on a bottom side of the steering actuator module 70 containing the third motor reduction gearing combination 71. Side to side sliding movement of the steering control member 28 under actuation of the crank 78*b* by the third motor reduction gearing combination 71 of the steering actuator module 70 pivots the proximal inner ends of both the front and rear carriages 38, 45 to the same lateral side 12*c* or 12*d* as the steering control member 28 and pivots the distal outer ends of both carriages 38, 45 including the front and rear road wheels 47 and 42 simultaneously in a remaining opposing lateral direction and side of the frame to steer the toy vehicle 10 in the remaining lateral direction of the remaining opposing lateral side. In this way, the crank 78*b*, third motor reduction gearing combination 71 and steering actuator module 70 are all operably connected with the front and rear wheel carriages 45, 38 and through the carriages with the front and rear road wheels 47, 42.

Figure 7:
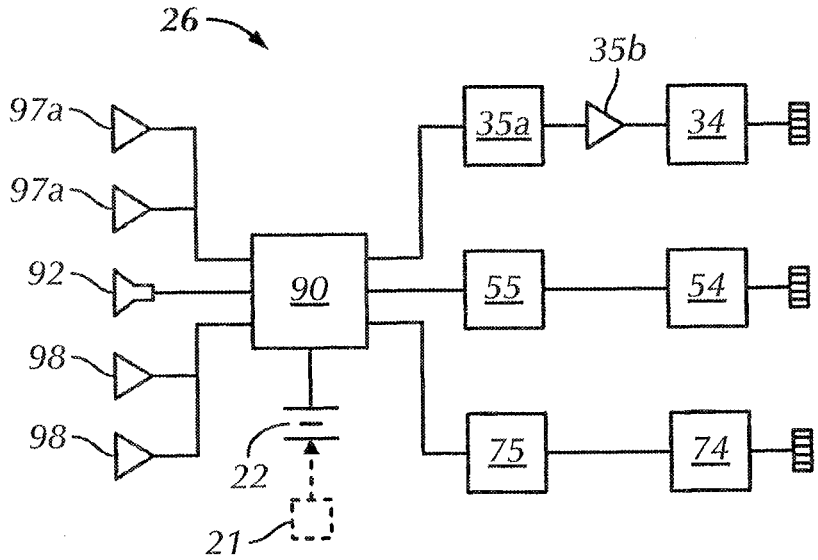
FIG. 7 is an exemplary circuit diagram.

Also protectively captured between the frame 12 and upper chassis member 24 are a preferably rechargeable power supply 22 and control electronics indicated generally at 26. Referring to FIG. 7, control electronics 26 includes a controller 90 preferably in the form of a microprocessor or equivalent Application Specific Integrated Circuit (ASIC) operably connected with the power supply 22, with the three motor/reduction gearing combinations 33, 53 and 71 through a motor driver circuit 35*a* and power amplifier 35*b* combination and through servo drivers 55 and 75, respectively, including stop switches (not separately depicted) mechanically coupled with the outputs of motor/reduction gearing combination 53, 71 to limit there operation and range of rotation, and with the lights 97, 98 and speaker 92 to control all operations. Rechargeable power supply 22 is operably connected with the jack 21. Preferably the controller 90 is preprogrammed or otherwise configured to perform a series of predetermined actions in a predetermined order including steering/movement of the vehicle, operation of the lights and/or generation of sounds. However, the control electronics could also include a wireless signal receiver operably connected with the controller 90, which would then be preprogrammed or otherwise configured to respond conventionally to commands from a user operated, remote control transmitter.

Figure 6:
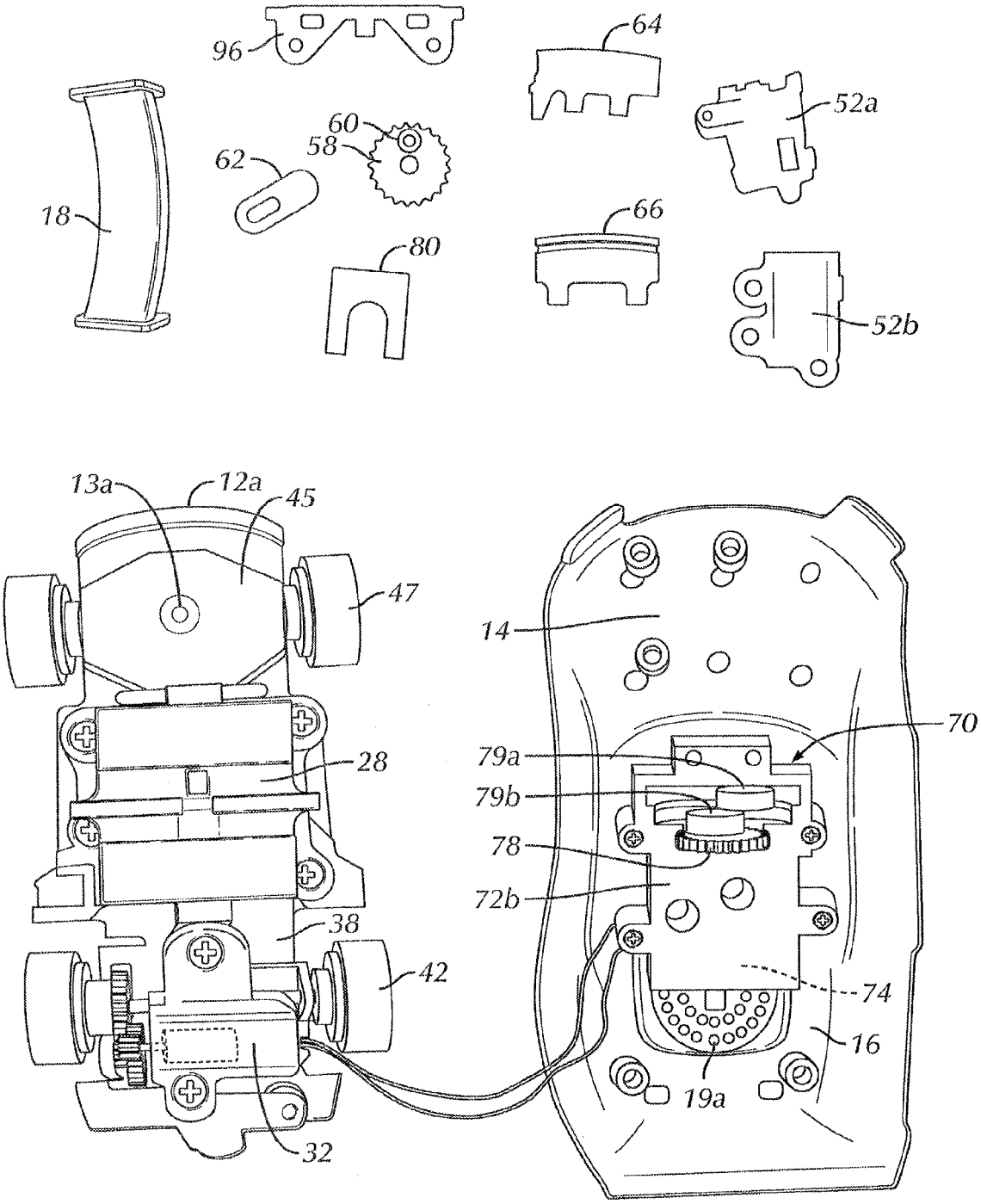
FIG. 6 is a third partially reassembled view of the toy vehicle of FIG. 3.

Referring to FIGS. 3 and 6, the steering actuator module 70 with third motor reduction gearing combination 71 includes a housing with upper and lower halves 72*a*, 72*b* receiving and supporting a motor (hidden in the lower housing) that drives a first speed reduction gear 76 with a central shaft extending longitudinally in the housing 72 between the rings of teeth at either end of the shaft. The front end of the first gear 76 meshes with a second speed reduction gear 77 also with two concentric rings of teeth, the smaller ring of which pivots a crank set 78 at the front end of the housing 72. Crank set 78 includes opposed cranks 79*a*, 79*b*, which are exposed through openings in the housing 72. The lower crank 79*b* engages and slides the control member/slide actuator 28 laterally side to side for steering. The upper crank 79*a* engages and operates an animated eye component in the form of a sliding eye member indicated generally at 80. The third motor reduction gearing combination 71 with stop switches at the crank output to limit the range of angular rotation of the cranks constitute a steering servo.

Still in FIG. 3, sliding eye member 80 has an inverted U shape with a pair of parallel arms 81*a* extending downwardly from a cross member 81*b*. A pair of "eyes" or, more specifically, "pupils" 81*c* extend forward and down from the cross member 81*b* and hook over an inner windshield 82 so as to be slidable side to side along a top edge of the windshield 82. Eyes/pupils 81*c* are dark in color and the inner front windshield 82 is light in color so that the eyes/pupils 81*c* can be seen on the windshield 82. The upper crank 78*a* of the module 70 is received between the downwardly extending arms 81*a* of the U shaped member 80 to move the member 80 and eyes/pupils 81*c* side to side while the front and rear carriages 45, 38 are being pivoted by the lower crank arm 78*b*. Preferably a window member 16 is molded to be fitted inside of the body 14 over the sliding eye assembly 80 to cover it and the other openings provided in the body 14 for the front window 15, side windows (unnumbered) and rear window 19.

The flexible member 20 forms the hood and grill area at the front of the toy vehicle 10 and is molded to define the nose 21*a* and mouth opening 21*b* beneath the nose and windshield eyes/pupils 81*c*. The FX module 51 sits inside and below the member 20 preferably on the front wheel carriage 45. Module 51 also preferably includes a housing with upper and lower halves 52*a*, 52*b* containing a motor 54 and speed reduction gearing indicated generally at 56 meshed with a geared wheel 58. Opposing upper and lower jaw members 64, 66 are supported on the front end of the housing 52 hinged on common axis and cammed together so as to pivot in opposite vertical directions. Vertical arcuate flanges 65*a* and 67*a* are provided at the foremost ends of jaw members 64, 66, and are connected with the flexible member 20 above and below the mouth opening 21*b* so that portions of the flexible member 20 above and below the opening 21*b* move like lips with up/down movement of the jaw members 64, 66. A pin 60 is eccentrically located on geared wheel 58 and is received in an elongated slot 62*a* in a rear end of a connecting link 62. The forward end of link 62 is non-rotatably connected to a lever arm 65*b* of the upper jaw member 64 such that rotational movement of the pin 60 is converted into pivotal movement of the arm 65*b* and upper jaw member 64 and opposing pivotal movement of the lower jaw member 66 opening and closing the mouth 50.

The body 14 is preferably mounted to the frame of the chassis to pivot about a central longitudinal axis so as to raise up one lateral side while simultaneously dropping the remaining lateral side. Preferably, an arm 94 with rounded upper/distal tip is fixedly mounted on the frame 12 extending upwardly behind the rear of the rear wheel carriage 38. A bracket 96 is fixedly attached to the inside of the rear of the vehicle body 14 and is configured to form a recess to seat on the arm 94 and support the rear of the body 14 for longitudinal pivotal movement. An upward and forward extending arm 25 is provided on the upper chassis member 24. The body 14 is itself also configured on its inner side to form a pivot seat configured to receive the top of arm 25 and support the front of the body 14 so that the body 14 can be pivoted about the aforesaid central longitudinal axis, which extends through upper distal tips of the arms 25, 94. The vehicle body 14 is thus supported on the vehicle frame 12 to pivot about the central longitudinal axis and configured to be rocked on the central longitudinal axis by operable connection with the steering control member 28. Preferably, the lateral outer edges of the ribs 30 on the steering control member 28 are configured (sized, shaped and located) to strike the proximal inside surface of the body 14 when the member 28 is moved to a right or left extreme lateral position while pivoting the carriages 38, 45. One or the other of the ribs 30 strikes and cams the body 14 to pivot the struck side of the body 14 upward on the arms 25, 96. The arms 25, 96 can also be used to pivotally secure the body 14 to the vehicle frame 12 so that the body 14 cannot be lifted away.

Figure 8:
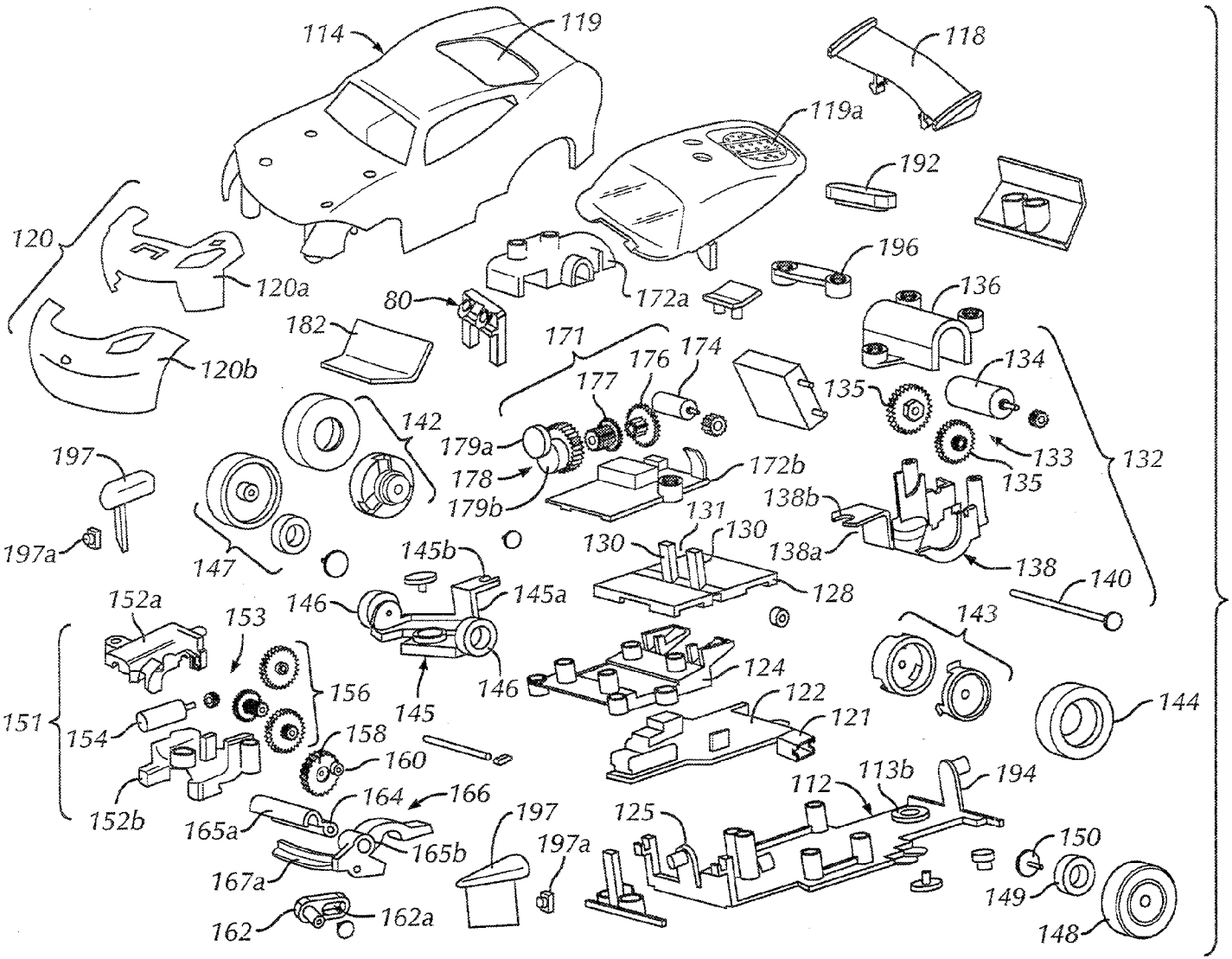
FIG. 8 is an exploded view of a second mechanical embodiment of the toy vehicle.

FIG. 8 depicts a second embodiment toy vehicle of the present invention indicated generally at 110. Most of the components of toy vehicle 110 at least identical in function if not also in appearance to those of toy vehicle 10 and are indicated by the same reference numerals increased by 100. Thus frame 112 corresponds functionally to frame 12 and body 114 to body 14. The major differences will now be noted.

The shapes of many of the components have been changed. Beyond that, the location of the control electronics 126 has changed. The propulsion module/subassembly 132 now has a cover 136 to retain parts in the carriage 138 forming a lower housing for the components of the propulsion module/subassembly 132. The construction of the road wheels has changed. The rear wheel hub 143 is now two piece. The tire and rim construction of the front wheels 47 has been replaced by one piece road wheels 147. A spacer 148 is provided to be located between the outer surface of the stub axle 136 and an inner circumferential surface of the wheel 147 corresponding to a tire. A retention pin 150 secures the wheel 147 to the stub shaft 146. The lever arm 165*b* of the mouth subassembly 151 has been moved from the upper jaw 164 to the lower jaw 166. The length of the first speed reduction gear 176 is shortened. The configuration of the body supporting pivot arms 125 and 194 has been changed and the latter has been made an integral part of the frame 112. The LED's for the front lights are separately shown at 197*a* and there are no taillight LED's shown although they are still optional.

It will be appreciated by those skilled in the art that still other changes could be made to the embodiments described above without departing from the broad inventive concept thereof. To that end, Hippely et al. U.S. Pat. No. 7,833,081 is attached hereto as an Appendix and incorporated by reference herein in its entirety for at least the changes it suggests. This invention is not limited to the particular embodiments disclosed.

We claim:

1. A toy vehicle comprising:

a plurality of rotatably mounted road wheels arranged to support the toy vehicle for movement on a support surface;

a structure movably mounted so as to generate an animated response of the toy vehicle;

a steering actuator operatively connected with at least one of the plurality of road wheels to pivot the at least one road wheel with respect to a vertical axis to steer the toy vehicle and to simultaneously move the structure to generate the animated response; and a controller operably connected with the steering actuator to selectively activate the steering actuator to move the structure and the steering control member to thereby pivot at least the one road wheel to selectively steer the toy vehicle simultaneously while generating the animated response.

2. The toy vehicle of claim 1 further comprising a vehicle frame; and a wheel carriage mounted on the vehicle frame to pivot about a first vertical axis, the at least one of the plurality of road wheels being rotatably mounted to the wheel carriage to rotate about a wheel axis fixed on the wheel carriage;

wherein the steering actuator is operatively connected with the wheel carriage to pivot the carriage with the at least one road wheel about the vertical axis and thereby steer the wheel carriage and the toy vehicle.

3. The toy vehicle of claim 2 wherein the wheel carriage is a first wheel carriage pivotally mounted on a first longitudinal end of the vehicle frame and the toy vehicle further comprising a second wheel carriage mounted on a second longitudinal end of the vehicle frame for pivotal movement about a second vertical axis, at least another of the plurality of road wheels being mounted for rotation on the second carriage, the steering actuator being directly operatively connected with each of the first and second wheel carriages to simultaneously pivot the first and second wheel carriages on the vehicle frame to simultaneously steer opposing ends of the toy vehicle.

4. The toy vehicle of claim 2 wherein the structure simulates a pair of eyes in a front windshield area of the toy vehicle.

5. The toy vehicle of claim 2 wherein the structure is a vehicle body supported on the vehicle frame to pivot about a central longitudinal axis of the toy vehicle and configured to be rocked on the central longitudinal axis by operable connection with the steering control member.

6. The toy vehicle of claim 2 wherein the steering actuator is a subassembly of the toy vehicle and comprises a servo providing a limited rotational output and a pair of opposed cranks coupled with the servo output to be pivoted over a limited angular range by the servo, one crank of the pair being operably connected with at least the wheel carriage and the other crank of the pair being operably connected with the structure to generate the animated response.

7. The toy vehicle of claim 3 further comprising a propulsion motor mounted on the first wheel carriage in driving connection with the at least one road wheel to rotate the at least one road wheel to propel the toy vehicle on the support surface.

8. A toy vehicle having opposing front and rear ends and comprising:

a vehicle frame;

a plurality of road wheels supported from the vehicle frame and supporting the toy vehicle for movement, at least one of the road wheels being mounted to the chassis for pivotal movement about a vertical axis so as to steer the toy vehicle;

a vehicle body mounted on the vehicle frame so as to rock about an other axis extending through the toy vehicle between the front and rear ends; and an actuator subassembly operatively connected with the at least one road wheel and the vehicle body so as to rock the vehicle body about the other axis while simultaneously pivoting the at least one road wheel to steer the toy vehicle.

9. The toy vehicle of claim 8:

wherein the vehicle frame has opposing front and rear ends and opposing lateral sides extending between the ends;

wherein the plurality of road wheels includes at least one front road wheel and at least one rear road wheel;

wherein the vehicle further comprises:

a front wheel carriage mounted for lateral side to side pivotal movement on the vehicle frame proximal the front end of the vehicle frame, the at least one front road wheel being mounted on the front wheel carriage for rotation on a horizontal transverse axis fixed on the front wheel carriage so as to support the front end of the frame for movement of the toy vehicle including turns; and a rear wheel carriage mounted for lateral side to side pivotal movement on the vehicle frame proximal the rear end of the vehicle frame, the at least one rear road wheel being mounted on the rear wheel carriage for rotation on a horizontal transverse axis fixed on the rear wheel carriage so as to support the rear end of the frame for movement including turns; and wherein the actuator subassembly includes:

a steering control member located between and operably connected directly with each of the front and rear wheel carriages so as to simultaneously pivot inner ends of the front and rear wheel carriages each proximal the steering control member in one lateral direction on the frame and thereby pivot outer ends of the front and rear wheel carriages each distal to the steering control member simultaneously in an opposing remaining lateral direction on the frame whereby the vehicle can be steered in the opposing remaining lateral direction; and a steering actuator configured to move the steering control member laterally to steer the toy vehicle in a desired lateral direction.

10. The toy vehicle of claim 9 wherein at least one of the front and rear wheel carriages supports a second road wheel, the at least one road wheel and the second road wheel being fixedly coaxial on opposite lateral sides of the at least one wheel carriage.

11. The toy vehicle of claim 10 further comprising a second structure movably mounted with respect to the chassis and configured to generate an animated response of the toy vehicle and wherein the steering actuator is configured to simultaneously move the second structure with the steering control member to generate the animated response simultaneously with the vehicle body and with the front and rear wheel carriages with the at least one front wheel and the at least one rear wheel, respectively, both being pivoted to steer the toy vehicle.

12. The toy vehicle of claim 11 wherein a remaining one of the front and rear wheel carriages also supports a second road wheel, the at least one road wheel and the second road wheel being fixedly coaxial on opposite lateral sides of the remaining wheel carriage.

13. The toy vehicle of claim 8 further comprising:

a second movable structure associated with the vehicle frame and adapted to be moved to generate an animated response; and the actuator subassembly further being operatively connected with the second movable structure and further being adapted to move the second movable structure to generate the animated response of the second movable structure and simultaneously steer the vehicle and pivot the vehicle body.

14. The toy vehicle of claim 13 wherein the second movable structure simulates a pair of eyes in a front windshield area of the toy vehicle.

* * * * *